US008878424B2

(12) United States Patent
Sumoyama et al.

(10) Patent No.: US 8,878,424 B2
(45) Date of Patent: Nov. 4, 2014

(54) SPARK PLUG

(75) Inventors: Daisuke Sumoyama, Nagoya (JP); Tomoo Tanaka, Kitanagoya (JP); Tsutomu Shibata, Owariasahi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 511 days.

(21) Appl. No.: 13/369,687

(22) Filed: Feb. 9, 2012

(65) Prior Publication Data

US 2012/0217864 A1 Aug. 30, 2012

(30) Foreign Application Priority Data

Feb. 10, 2011 (JP) ..... 2011-27705

(51) Int. Cl.
*H01T 13/39* (2006.01)

(52) U.S. Cl.
CPC ..... *H01T 13/39* (2013.01)
USPC ..... 313/141; 445/7

(58) Field of Classification Search
CPC ..... H01T 13/16; H01T 13/20; H01T 13/34; H01T 13/39
USPC ..... 313/141; 445/7
See application file for complete search history.

(56) References Cited

U.S. PATENT DOCUMENTS

| | | | | |
|---|---|---|---|---|
| 4,742,265 | A | 5/1988 | Giachino et al. | 313/141 |
| 2002/0158559 | A1 * | 10/2002 | Sugiyama et al. | 313/141 |

FOREIGN PATENT DOCUMENTS

| | | | | |
|---|---|---|---|---|
| JP | 63-138681 | 6/1988 | | H01T 13/39 |
| JP | 5-114457 | A 5/1993 | | H01T 13/20 |
| JP | 2007-170215 | 7/2007 | | F01N 13/08 |

* cited by examiner

*Primary Examiner* — Andrew Coughlin
(74) *Attorney, Agent, or Firm* — Kusner & Jaffe

(57) ABSTRACT

A spark plug having an insulator that can be restrained from cracking in an environment of heating and cooling cycles. The spark plug includes an insulator having an axial bore extending in the direction of the axis, and a center electrode held in one end portion of the axial bore. The center electrode has an outer layer, and a core provided within the outer layer and formed from a material higher in thermal conductivity than the outer layer. After a heat treatment, the outer layer has a high-hardness region having a hardness of 190 Hv or higher and a thickness of 30 μm to 200 μm, and an element supply region having a thickness of 50 μm or more.

9 Claims, 2 Drawing Sheets

SPARK PLUG

FIELD OF THE INVENTION

The present invention relates to a spark plug and particularly to a spark plug in which a center electrode has a core provided therein and formed from a material having high thermal conductivity.

BACKGROUND OF THE INVENTION

Generally, a spark plug used for providing ignition in an internal combustion engine, such as an automotive engine, includes a tubular metallic shell; a tubular insulator disposed in a bore of the metallic shell; a center electrode disposed in a forward end portion of a bore of the insulator; and a ground electrode whose one end is joined to the forward end of the metallic shell and whose other end forms a spark discharge gap in cooperation with the center electrode. The spark plug generates spark discharges across the spark discharge gap formed between the forward end of the center electrode and the distal end of the ground electrode within a combustion chamber of the internal combustion engine, thereby combusting fuel which fills the combustion chamber.

In recent years, there has been developed a technique for increasing driving distance with less fuel through improvement of output by use of a supercharger. In such an internal combustion engine, temperature within a combustion chamber tends to increase; particularly, temperature in a region where the front end of the center electrode is located tends to increase. In order to cope with such temperature tendency, the following structure may be employed: a core higher in thermal conductivity than an Ni-based alloy; for example, a copper core, is disposed in an axial portion of the center electrode for promoting conductive release of discharge-generated heat (may be referred to as heat transfer) from the center electrode to the metallic shell.

However, in association with development of a small-sized spark plug for the purpose of enhancing the degree of design freedom for an internal combustion engine, the center electrode becomes slender. Such a slender center electrode may suffer the following phenomenon: in an environment of severe heating and cooling cycles, for example, the difference in thermal expansion between the copper core provided in an axial portion of the center electrode and an Ni-based alloy which surrounds the copper core causes plastic deformation or creep deformation of the center electrode, and the deformed center electrode pushes and cracks the adjacent insulator.

Patent Document 1 (Japanese Patent Application Laid-Open (kokai) No. 2009-170215) describes the invention whose object is "to provide a spark plug for an internal combustion engine configured such that, while a drop in thermal value is prevented, cracking of an insulator is restrained" (refer to Paragraph 0008 of Patent Document 1). In order to solve the problem, the described invention provides "a spark plug characterized in that: the center electrode has an engagement portion for determining the axial position of the center electrode relative to the insulator; the insulator has a seat portion formed on the inner wall of its axial bore for receiving the engagement portion of the center electrode inserted into the axial bore; and the inner wall of the axial bore has a parallel portion located forward of the seat portion and formed in parallel with the outer side surface of the center electrode, and a diameter-expanded portion formed between the parallel portion and the seat portion and being greater in clearance to the outer side surface of the center electrode than the parallel portion" (refer to claim 1 of Patent Document 1).

Patent Document 1 describes the following merit of the invention: when combustion residue enters a clearance between the center electrode and the insulator, the combustion residue preferentially accumulates in the clearance between the center electrode and the diameter-expanded portion of the insulator; thus, the combustion residue accumulated in the diameter-expanded portion serves as a stress relaxation layer to avoid direct transmission, to the insulator, of stress induced by thermal expansion of the center electrode, whereby cracking of the insulator can be restrained.

However, since the temperature within a combustion chamber tends to increase further, and the spark plug size tends to reduce, demand has been rising for a spark plug in which cracking of the insulator is further restrained.

SUMMARY OF THE INVENTION

Problems to be Solved by the Invention

An object of the present invention is to provide a spark plug whose insulator can be restrained from cracking in an environment of heating and cooling cycles.

Means for Solving the Problems

A means for solving the problems is a spark plug configured as follows.

(1) The spark plug comprises an insulator having an axial bore extending in a direction of an axis, and a center electrode held in one end portion of the axial bore. The center electrode includes a core, and an outer layer covering the core. The core is formed from a material higher in thermal conductivity than the outer layer. After heat treatment of application of heat at 1,000° C. for five hours in the atmosphere, the outer layer has a high-hardness region having a hardness of 190 Hv or higher and a thickness of 30 μm to 200 μm, and an element supply region whose subregion in the vicinity of a surface of the outer layer contains Cr in an amount of 15 mass % to 40 mass % and Al in an amount of 0 mass % to 38 mass %, or Al in an amount of 5 mass % to 38 mass % and Cr in an amount of 0 mass % to 40 mass % and whose deeper subregion contains Cr in an amount of 7 mass % to 40 mass % and Al in an amount of 0 mass % to 38 mass %, or Al in an amount of 3 mass % to 38 mass % and Cr in an amount of 0 mass % to 40 mass %. The element supply region has a thickness of 50 μm or more.

Preferably, the spark plug mentioned above in (1) is such that:

(2) the high-hardness region has an ultrahigh-hardness region having a hardness of 230 Hv or higher, and the ultrahigh-hardness region has a thickness of 30 μm to 200 μm;

(3) the high-hardness region has a thickness of 80 μm to 200 μm;

(4) the high-hardness region has a thickness of 80 μm to 200 μm, and the ultrahigh-hardness region has a thickness of 30 μm to 80 μm;

(5) the ultrahigh-hardness region has a thickness of 80 μm to 200 μm;

(6) the element supply region has a thickness of 100 μm or more;

(7) with a side of the axial bore toward the center electrode being referred to as a forward side with respect to the direction of the axis, a shortest distance (hereinafter referred to as a radial difference) between an outer circumferential surface of the center electrode and an inner circumferential surface of the axial bore is 0.03 mm to 0.1 mm as measured within a range extending along the direction of the axis (O) from a forward end of the core (7) to an axial position located 4 mm rearward of the forward end; or (8) the radial difference is 0.03 mm to 0.07 mm.

Another means for solving the problems is a spark plug configured as follows.

(9) The spark plug comprises an insulator having an axial bore extending in a direction of an axis, and a center electrode held in one end portion of the axial bore. The center electrode includes a core and an outer layer covering the core. The core is formed from a material higher in thermal conductivity than the outer layer. Through heat treatment of application of heat at 1,000° C. for five hours in the atmosphere, the outer layer has a high-hardness region having a hardness of 190 Hv or higher and a thickness of 30 μm to 200 μm, and an element supply region whose subregion in the vicinity of a surface of the outer layer contains Cr in an amount of 15 mass % to 40 mass % and Al in an amount of 0 mass % to 38 mass %, or Al in an amount of 5 mass % to 38 mass % and Cr in an amount of 0 mass % to 40 mass %, whose deeper subregion contains Cr in an amount of 7 mass % to 40 mass % and Al in an amount of 0 mass % to 38 mass %, or Al in an amount of 3 mass % to 38 mass % and Cr in an amount of 0 mass % to 40 mass %, and which has a thickness of 50 μm or more.

Effect of the Invention

The spark plug according to the present invention includes the center electrode which has the outer layer and the core provided within the outer layer and formed from a material higher in thermal conductivity than the outer layer. After heat treatment of application of heat at 1,000° C. for five hours in the atmosphere, the outer layer has the high-hardness region having a predetermined hardness and a predetermined thickness and the element supply region whose Cr and Al contents fall within respective predetermined ranges and which has a predetermined thickness. Thus, deformation of the center electrode is restrained, and accumulation of oxides on the surface of the center electrode can be restrained. Therefore, there can be provided a spark plug configured to restrain cracking of the insulator caused by displacement of the center electrode.

Through employment of a radial difference which falls within a predetermined range, even when the center electrode deforms, a clearance can be secured between the center electrode and the insulator to such an extent as not to allow stress associated with the deformation to cause cracking of the insulator. Also, since deposits within a combustion chamber become less likely to enter the clearance between the center electrode and the insulator, cracking of the insulator caused by the deposits can be restrained. Also, the following problems can be prevented: combustion gas enters the clearance between the center electrode and the insulator and causes an increase in temperature of the center electrode with resultant oxidation of the outer layer of the center electrode, and deformation of the center electrode combined with the oxidation further reduces the clearance between the center electrode and the insulator and causes retraction of the center electrode relative to the insulator with a resultant increase in the gap between the center electrode and the ground electrode. Furthermore, since heat which the insulator has received is readily released to the center electrode, there can be prevented thermal erosion of the spark plug which could otherwise result from overheating of the insulator.

BRIEF DESCRIPTION OF THE DRAWINGS

FIG. 2(*b*) is an explanatory sectional view of essential portions of a center electrode, showing positions where hardness is measured.

DETAILED DESCRIPTION OF THE INVENTION

A spark plug according to the present invention has a center electrode and a ground electrode which are disposed such that one end of the center electrode and one end of the ground electrode face each other with a gap therebetween. The center electrode includes a core, and an outer layer covering the core. The core is formed from a material higher in thermal conductivity than the outer layer. So long as the spark plug according to the present invention has the above configuration, no particular limitation is imposed on other configurational features; i.e., publicly known configurational features can be employed.

Figure 1:
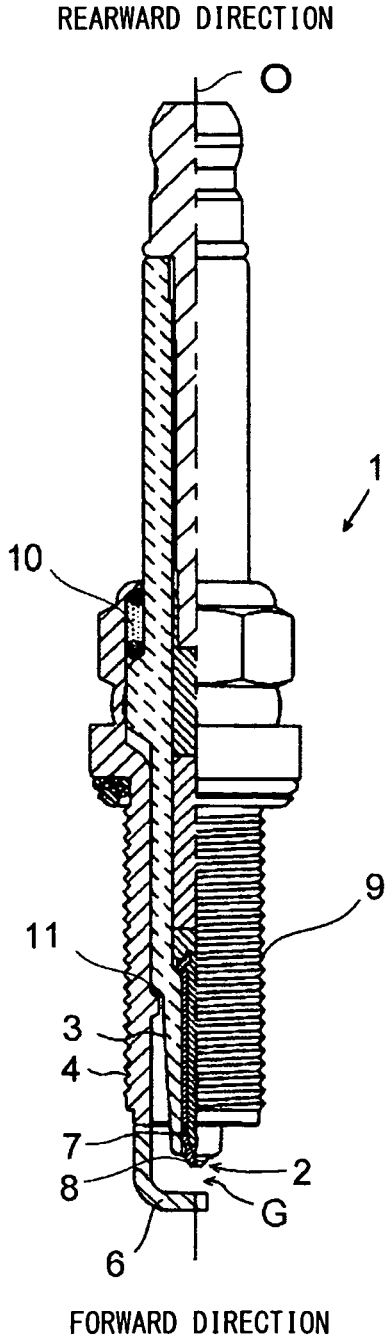
FIG. 1 is a partially sectional explanatory view showing the entire configuration of a spark plug according to an embodiment of the present invention.

FIG. 1 shows a spark plug according to an embodiment of the present invention. FIG. 1 is a partially sectional explanatory view showing the entire configuration of a spark plug 1 according to the embodiment of the present invention. In the following description, a downward direction on the paper on which FIG. 1 appears is referred to as a forward direction along the axis O, and an upward direction on the paper is referred to as a rearward direction along the axis O.

As shown in FIG. 1, the spark plug 1 includes a substantially rodlike center electrode 2; a substantially cylindrical insulator 3 disposed externally of the outer circumference of the center electrode 2; a cylindrical metallic shell 4 which holds the insulator 3 therein; and a ground electrode 6 whose one end faces the forward end surface of the center electrode 2 with a spark discharge gap G therebetween and whose other end is joined to the end surface of the metallic shell 4.

The metallic shell 4 has a cylindrical shape and is formed to hold the insulator 3 which is inserted therein. The metallic shell 4 has a threaded portion 9 formed on a forward portion of its outer circumferential surface. The spark plug 1 is mounted to the cylinder head of an unillustrated internal combustion engine by utilizing the threaded portion 9 of the metallic shell 4. The metallic shell 4 can be formed from an electrically conductive steel material, such as a low-carbon steel.

The insulator 3 is held in an inner circumferential portion of the metallic shell 4 via a talc 10, a packing 11, etc. The insulator 3 has an axial bore 5 for holding the center electrode 2 therein along the axial direction of the insulator 3. The insulator 3 is fixed in the metallic shell 4 in such a condition that a forward end portion of the insulator 3 projects from the forward end surface of the metallic shell 4. Desirably, the insulator 3 is of a material having mechanical strength, thermal strength, and electrical strength. Such a material is, for example, a ceramic sintered body which contains alumina as a main component.

The ground electrode 6 assumes the form of, for example, a substantially rectangular columnar body. The shape and the structure of the ground electrode 6 are designed as follows: one end of the ground electrode 6 is joined to an end surface of the metallic shell 4; the body of the ground electrode 6 is bent at an intermediate position so as to assume a shape resembling the letter L; and a distal end portion of the ground electrode 6 is located so as to align with the axial direction of the center electrode 2. By virtue of the ground electrode 6 being designed in such a manner, one end of the ground electrode 6 is disposed in such a manner as to face the center electrode 2 via the spark discharge gap G. In the present embodiment, the spark discharge gap G is a gap between the forward end surface of the center electrode 2 and a side surface of a distal end portion of the ground electrode 6. The spark discharge gap G is usually set to 0.3 mm to 1.5 mm.

The center electrode 2 is fixed in the axial bore 5 of the insulator 3 in such a manner that a forward end portion thereof projects from the forward end surface of the insulator 3, thereby being held in place relative to the metallic shell 4 while being electrically insulated from the metallic shell 4. The center electrode 2 is composed of a core 7 and an outer layer 8, which covers the core 7. The core 7 is formed from a material higher in thermal conductivity than the outer layer 8. Examples of such a material include Cu, a Cu alloy, Ag, and pure Ni. When the core 7 is to be formed from a Cu alloy, in view of maintenance of high thermal conductivity, the Cu content of the Cu alloy is preferably 95 mass % or higher. The composition of the outer layer 8 is described herein later.

The outer layer 8 has a high-hardness region having a hardness of 190 Hv or higher as measured, by a method to be described later, after the spark plug 1 is subjected to heat treatment of application of heat at 1,000° C. for five hours in the atmosphere, and having a hardness of 30 μm to 200 μm. Hardness and other characteristics of materials of the center electrode 2 vary after the center electrode 2 is placed in a high-temperature environment, as compared with those before the center electrode 2 is placed in such an environment. Conceivably, as a result of the center electrode 2 being placed in a high-temperature environment, the variation of hardness is initiated by elimination of strains which have been generated in the materials in association with machining or the like of the materials. Since, during operation of an internal combustion engine, temperature within a combustion chamber increases up to about 1,000° C., material characteristics after placement in such a temperature environment are important. Hardness before placement in such a high temperature environment varies greatly according to machining conditions, such as working temperature and working rate, in forming the center electrode 2. Thus, even though hardness before placement in such a high temperature environment is high, hardness is not necessarily high in an environment in which the spark plug 1 is used. Therefore, the hardness and thickness of the outer layer 8 are measured after the spark plug 1 is subjected to heat treatment.

Preferably, the thickness of the high-hardness region is 80 μm to 200 μm. Particularly, in the case where the outer layer 8 has a high-hardness region having such a thickness in the vicinity of the surface thereof, the center electrode 2 can be restrained from deforming even in an environment of severe heating and cooling cycles.

When the thickness of a region having a hardness of 190 Hv or higher is less than 30 μm, the center electrode 2 may deform in an environment of heating and cooling cycles, potentially resulting in cracking of the insulator 3. When the thickness of a region having a hardness of 190 Hv or higher is in excess of 200 μm, cracking is apt to occur in the surface of the outer layer 8, and oxidation is apt to progress through the cracking at an accelerated pace.

Preferably, the high-hardness region has an ultrahigh-hardness region having a hardness of 230 Hv or higher and a thickness of 30 μm to 200 μm. Furthermore, particularly preferably, the high-hardness region has a thickness of 80 μm to 200 μm, and the ultrahigh-hardness region has a thickness of 80 μm to 200 μm.

When the outer layer 8 has an ultrahigh-hardness region having a thickness of 30 μm to 200 μm, the center electrode 2 can be further restrained from deforming in an environment of heating and cooling cycles. Furthermore, when the high-hardness region has a thickness of 80 μm to 200 μm, the restraining effect is further enhanced. When both of the high-hardness region and the ultrahigh-hardness region have a thickness of 80 μm to 200 μm, the restraining effect is most enhanced.

As is found by WDS analysis conducted through utilization of EPMA after the spark plug 1 is subjected to heat treatment of application of heat at 1,000° C. for five hours in the atmosphere, the outer layer 8 has an element supply region whose subregion in the vicinity of the surface of the outer layer 8 contains Cr in an amount of 15 mass % to 40 mass % and Al in an amount of 0 mass % to 38 mass %, or Al in an amount of 5 mass % to 38 mass % and Cr in an amount of 0 mass % to 40 mass % and whose deeper subregion contains Cr in an amount of 7 mass % to 40 mass % and Al in an amount of 0 mass % to 38 mass %, or Al in an amount of 3 mass % to 38 mass % and Cr in an amount of 0 mass % to 40 mass %. The element supply region has a thickness of 50 μm or more, and the thickness of the element supply region is usually equal to or less than that of the outer layer 8. The composition of the outer layer 8 after heat treatment is specified for the following reason: similar to the above-mentioned case of hardness, since temperature within a combustion chamber during operation of an internal combustion engine increases up to about 1,000° C., material characteristics after placement in such a temperature environment are important.

So long as the outer layer 8 has the element supply region whose Cr and Al contents fall within respective particular ranges, no particular limitation is imposed on the composition of a base metal of the outer layer 8; i.e., on the contents of elements other than Cr and Al contained in the outer layer 8. The composition of the base metal of the outer layer 8 can be similar to those of publicly known materials used as base metals of center electrodes. Examples of such material include INC600 (registered trademark), which has oxidation resistance and high-temperature strength, and a high-Ni-content alloy and pure Ni, which have high thermal conductivity.

In the case where the element supply region having a thickness of 50 μm or more does not exist in the vicinity of the surface of the outer layer 8, when the center electrode 2 is exposed to a high-temperature high-oxygen-concentration environment within a combustion chamber of an internal combustion engine, Ni, Fe, Co, etc. contained in the base metal of the outer layer 8 are apt to be oxidized, thereby forming oxides on the surface of the center electrode 2. Since these oxides are low in adhesion to the surface of the center electrode 2, the oxides exfoliate from the surface of the center electrode 2, and new oxides are formed on the surface of the center electrode 2 from which the former oxides have exfoliated. In association with repetition of such exfoliation and formation of oxides, the oxides accumulate between the center electrode 2 and the insulator 3 and narrow the clearance between the center electrode 2 and the insulator 3. As a result, upon occurrence of even a slight deformation of the center electrode 2, the insulator 3 is pressed by the center electrode 2 and the oxides and thus is apt to crack.

In the case where the element supply region having a thickness of 50 μm or more exists in the vicinity of the surface of the outer layer 8, since Cr and Al are slow in diffusion in oxides of Cr and/or Al, even when the center electrode 2 is exposed to a high-temperature high-oxide-concentration environment for a long period of time, oxides of Cr and/or Al formed on the surface of the center electrode 2 do not grow much and cover the center electrode 2 in the form of a thin oxide film. Also, since oxides of Cr and/or Al are lower in dissociation oxygen pressure than oxides of Ni, Fe, Co, etc., Ni, Fe, Co, etc. contained in the base metal covered with the oxide film become less likely to be oxidized, thereby restraining formation of a thick oxide film between the center electrode 2 and the insulator 3. As a result, even when the center electrode 2 is deformed, since a clearance is secured between the center electrode 2 and the insulator 3 to such an extent that the insulator 3 is not cracked by stress induced by the deformation, the insulator 3 can be less likely to crack.

When a region in the vicinity of the surface of the outer layer 8; i.e., a region ranging from the surface of the outer layer 8 to a depth of at least 50 μm, contains Cr in an amount of less than 15 mass % and Al in an amount of less than 5 mass %, it is unlikely that a thin oxide film of Cr and/or Al is continuously formed over the entire surface of the outer layer 8. Also, even though the outer layer 8 contains Cr in an amount of at least 7 mass % or Al in an amount of at least 3 mass %, if the thickness of the element supply region is less than 50 μm, upon exfoliation of a formed thin oxide film of Cr and/or Al, Cr and/or Al required for re-forming a thin oxide film on the surface of the outer layer 8 cannot be supplied from the inside of the outer layer 8. Thus, a thin oxide film of Cr and/or Al is not formed, and oxides of Ni, Fe, Co, etc. are apt to be formed. As a result, a thick oxide film is formed between the center electrode 2 and the insulator 3, resulting in likelihood of cracking of the insulator 3.

When a region in the vicinity of the surface of the outer layer 8 contains Cr in excess of 40 mass %, a Cr solid solution, whose thermal expansion coefficient is low, precipitates in a high-temperature environment. Because of a large difference in thermal expansion coefficient between the Cr solid solution and the base metal of the outer layer 8, a surface region of the outer layer 8 is apt to exfoliate. Also, when the Al content exceeds 38 mass %, a $\delta Ni_2Al_3$ phase, which is very fragile, precipitates in a large amount. Therefore, even though the outer layer 8 has the high-hardness region, the outer layer 8 is of no practical use.

No particular limitation is imposed on the Cr and Al contents so long as the Cr and Al contents of a region ranging from the surface of the outer layer 8 to a depth of at least 50 μm fall within the above-mentioned respective content ranges. The region may contain either one of Cr and Al, or the region may contain Cr and Al in respective amounts which fall within the above-mentioned respective content ranges.

No particular limitation is imposed on the Cr and/or Al content of the element supply region so long as a region in the vicinity of the surface of the outer layer 8; for example, a region ranging from the surface of the outer layer 8 to a depth of at least 20 μm, contains Cr in an amount of 15 mass % to 40 mass % and Al in an amount of 0 mass % to 38 mass %, or Al in an amount of 5 mass % to 38 mass % and Cr in an amount of 0 mass % to 40 mass %. The entire region of the outer layer 8 may contain Cr and/or Al in respective amounts which fall within the above-mentioned respective content ranges. Alternatively, the Cr and/or Al content may be inclined such that, while a region in the vicinity of the surface of the outer layer 8 contains Cr and/or Al in respective amounts which fall within the above-mentioned respective content ranges, the Cr and/or Al content gradually reduces inward from the surface of the outer layer 8. Furthermore, the outer layer 8 may have a surface layer which has a particular thickness and contains Cr and/or Al in respective fixed amounts falling within the above-mentioned content ranges, and an internal region which is located inward of the surface layer and contains Cr in an amount of at least 7 mass % or Al in an amount of at least 3 mass % such that the Cr or Al content is lower than that of the surface layer.

Figure 2A:
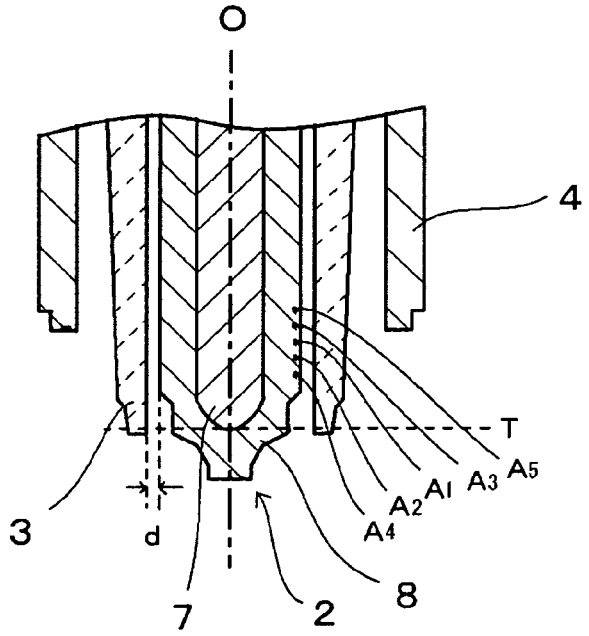
FIG. 2(*a*) is an explanatory sectional view of essential portions of the spark plug as cut along a plane which contains the axis O.
Figure 2B:
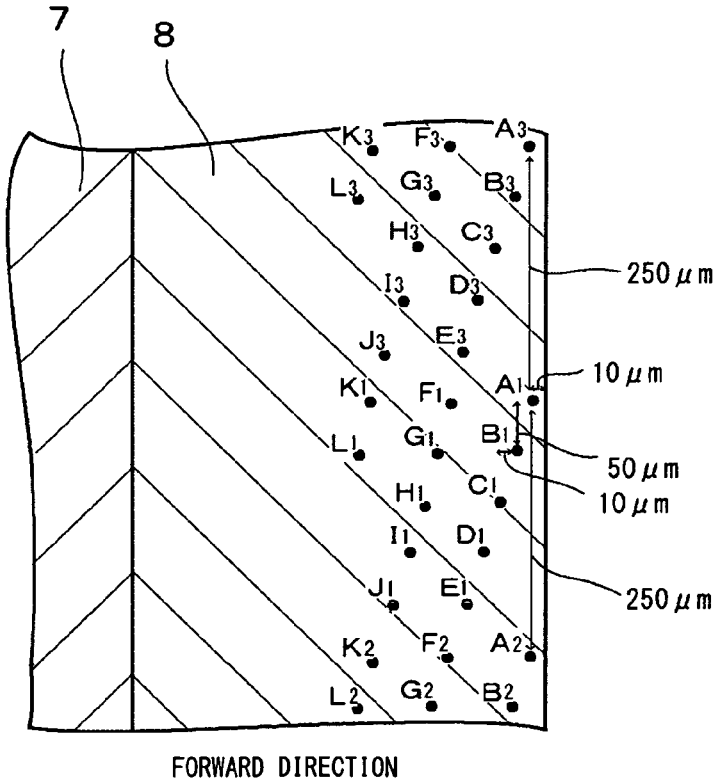

A shortest distance (hereinafter referred to as a radial difference) d between the outer circumferential surface of the center electrode 2 and the inner circumferential surface of the axial bore 5 is preferably 0.03 mm to 0.1 mm, particularly preferably 0.03 mm to 0.07 mm, as measured within a range extending along the direction of the axis O from the forward end of the core 7 to an axial position located 4 mm rearward of the forward end (see FIG. 2(*a*)).

Through employment of a radial difference of 0.03 mm or more, even when the center electrode 2 deforms, a clearance can be secured between the center electrode 2 and the insulator 3 to such an extent as not to allow stress associated with the deformation to cause cracking of the insulator 3, thereby preventing cracking of the insulator 3 which could otherwise result from displacement of the center electrode 2. Also, through employment of a radial difference of 0.1 mm or less, particularly 0.07 mm or less, deposits within a combustion chamber become less likely to enter the clearance between the center electrode 2 and the insulator 3, whereby cracking of the insulator 3 caused by the deposits can be restrained. Also, the following problems can be prevented: combustion gas enters the clearance between the center electrode 2 and the insulator 3 and causes an increase in temperature of the center electrode 2 with resultant oxidation of the outer layer 8 of the center electrode 2, and deformation of the center electrode 2 combined with the oxidation further reduces the radial difference between insulator 3 and the center electrode 2 and causes retraction of the center electrode 2 relative to the insulator 3 with a resultant increase in the gap between the center electrode 2 and the ground electrode 6. Furthermore, in the event of overheating of the insulator 3 in a high-temperature environment, since heat of the insulator 3 is readily released via the center electrode 2, there can be prevented thermal erosion of the spark plug 1 which could otherwise result from the insulator 3 having an abnormally high temperature.

Hardness of the outer layer 8, the thickness of the high-hardness region, and the thickness of the ultrahigh-hardness region can be measured by the following methods. FIG. 2(*a*) is an explanatory sectional view of essential portions of the spark plug 1 as cut along a plane which contains the axis O. FIG. 2(*b*) is an explanatory sectional view of essential portions of the center electrode 2, showing positions where hardness is measured.

First, the spark plug 1 is subjected to heat treatment of application of heat at 1,000° C. for five hours in the atmosphere. Subsequently, as shown in FIG. 2(*a*), essential portions of the spark plug 1 are cut along a plane which contains the axis O. On the thus-obtained section, hardness is measured. Measurement of hardness starts from position $A_1$. Position $A_1$ is located at an axial position which falls within an axial range extending 1 mm to 5 mm rearward from a forward end T of the core 7; at which the center electrode 2 is presumed to deform to the greatest extent during operation of an engine or the like to which the spark plug 1 is mounted; and which is located 10 μm radially inward from the surface of the center electrode 2. Second to fifth measuring positions are respectively located 250 μm and 500 μm forward and rearward of position $A_1$. Hardness is measured at a total of five positions; namely, positions $A_1$ to $A_5$. The arithmetic mean of hardnesses measured at the five positions is calculated, thereby yielding an average hardness. Next, hardness is measured at positions $B_1$ to $B_5$, which are located 10 μm radially inward of and 50 μm forward of positions $A_1$ to $A_5$, respectively. Similarly, hardness is measured at 50 μm intervals in the axial direction and 10 μm intervals in the radial direction up to positions $E_1$ to $E_5$, which are located 40 μm radially inward of and 200 μm forward of positions $A_1$ to $A_5$, respectively. Measuring positions $F_1$ to $F_5$ are located at the same axial positions as those of positions $A_1$ to $A_5$, respectively, and 10 μm radially inward of positions $E_1$ to $E_5$, respectively. Subsequently, hardness is measured at similarly determined measuring positions. The arithmetic mean of hardnesses measured at five positions located at the same radial distance from the surface of the center electrode 2 is calculated, thereby yielding an average hardness. The radial distance from the surface to a position where the average hardness is 230 Hv or higher is defined as the thickness of the ultrahigh-hardness region. The radial distance from the surface to a position where the average hardness is 190 Hv or higher is defined as the thickness of the high-hardness region. In the case of a circular columnar center electrode, the center electrode has substantially the same diameter along the axis O, so that hardness can be measured as mentioned above. However, in the case where the center electrode has a small-diameter portion (the clearance between the insulator and the small-diameter portion is slightly wider) in the vicinity of the forward end of the center electrode, and difficulty is encountered in measuring hardness as mentioned above at the small-diameter portion, hardness may be measured at a total of five measuring points located rearward of the measuring start position A1.

The position of starting measurement of hardness is predetermined as follows: a preliminary spark plug sample is subjected to a durability test to find out a position which falls within an axial range extending 1 mm to 5 mm rearward from the forward end T of the core 7 and at which the center electrode 2 deforms to the greatest extent as observed within the range. The durability test performs, for example, 3,000 heating and cooling cycles, each consisting of heating a spark plug sample at 900° C. with a burner for three minutes and subsequent cooling for one minute.

Hardness is measured by use of a Vickers hardness meter according to JIS Z 2244 except for the following conditions: a load of 1 N, a holding time of 10 seconds, and the above-mentioned measuring positions.

The Cr and Al contents of the outer layer 8 and the thickness of the element supply region can be measured as follows. At the positions in the outer layer 8 where hardness is measured, the Cr and Al contents can be measured by WDS analysis conducted through utilization of EPMA. Specifically, the arithmetic means of analyzed values at positions $A_1$ to $A_5$ are calculated, thereby yielding the Cr and Al contents of a subregion, in the vicinity of the surface of the outer layer 8, of the element supply region. Also, the arithmetic means of analyzed values obtained at positions $A_1$ to $A_5$, $B_1$ to $B_5$, . . . are calculated, positions $B_1$ to $B_5$ . . . being located at 10 μm intervals from positions $A_1$ to $A_5$ in the radial direction. On the basis of the arithmetic means, a radial position which satisfies a Cr content of 7 mass % or higher or an Al content of 3 mass % or higher is obtained. The radial distance between the obtained radial position and the surface of the outer layer 8 can be defined as the thickness of the element supply region.

The thickness of the high-hardness region, the thickness of the ultrahigh-hardness region, and the thickness of the element supply region can be adjusted, for example, by adjusting processing time and processing temperature in forming a surface layer by a method to be described later, and by grinding the surface of the surface layer after processing.

As mentioned above, the spark plug 1 of the present embodiment has the center electrode 2 having the high-hardness region and the element supply region. Thus, even when the spark plug 1 is exposed to an environment of cooling and heating cycles, deformation of the center electrode 2 can be restrained, and thick accumulation of oxides on the surface of the center electrode 2 can be restrained. Therefore, cracking of the insulator 3 which could otherwise result from displacement of the center electrode 2 can be restrained.

The spark plug 1 is manufactured, for example, in the following manner. First, a method of manufacturing the center electrode 2 is described. For example, a base metal having the same composition as that of INC600 is melted and adjusted. The adjusted base metal is formed into the shape of a cup, thereby yielding a cup body which will become the outer layer 8. Also, a material, such as Cu, higher in thermal conductivity than the base metal is melted, followed by plastic working or the like for forming a rod body which will become the core 7. The rod body is inserted into the cup body. The resultant assembly is subjected to extrusion or a like plastic working. The resultant workpiece is formed into a desired shape by plastic working, thereby yielding a composite body configured such that the rod body is disposed within the cup body.

Next, a surface layer having a predetermined composition is formed on the surface of the composite body by, for example, a plating process, such as fused-salt electroplating or fused-salt electroless plating, a thermal spraying process, such as air plasma spraying (APS), high velocity oxygen fuel (HVOF) thermal spraying, or low pressure plasma spraying (LPPS), a chemical vapor deposition (CVD) process, or a vapor diffusion coating process. The surface layer serves as a surface portion of the outer layer 8.

Among the above-mentioned processes for forming the surface layer, high velocity oxygen fuel (HVOF) thermal spraying and low pressure plasma spraying (LPPS) can form a dense surface layer having less inclusion of oxides and fewer internal defects as compared with air plasma spraying (APS) and thus can readily form a surface layer having a high hardness of 190 Hv or higher and 230 Hv or higher. After a surface layer is formed on the surface of the composite body by any one of the above-mentioned thermal spraying processes, by means of the composite body having the surface layer being subjected to heat treatment of application of heat at 700° C. to 1,050° C. for 0.1 hour to 20 hours in a nonoxidizing atmosphere, such as in Ar or in vacuum, the composition of the surface layer can be homogenized, and adhesion between the base metal and the surface layer can be improved. Before the surface layer is formed on the surface of the composite body by any one of the above-mentioned thermal spraying processes, roughening the surface of the composite body by, for example, a blasting process further improves the adhesion.

Since the vapor diffusion coating process can diffuse a particular element inward from the surface of the composite body, the process can form a surface layer having, for example, such an inclined composition that the content of a particular element gradually reduces. Therefore, the vapor diffusion coating process can restrain separation of the surface layer from the base metal. Since the vapor diffusion coating process encounters difficulty in diffusing elements of low vapor pressure, such as Ir, the vapor diffusion coating process may be combined with another process, for diffusing elements which the vapor diffusion coating process encounters difficulty in adding. After a surface layer is formed on the surface of the composite body by the vapor diffusion coating process, by means of the composite body having the surface layer being subjected to heat treatment of application of heat at 700° C. to 1,050° C. for 0.1 hour to 20 hours in a nonoxidizing atmosphere, such as Ar or a vacuum, the composition of the surface layer can be homogenized to a higher extent, and adhesion between the base metal and the surface layer can be further improved.

After a surface layer is formed on the composite body by any one of the above-mentioned thermal spraying processes or by the vapor diffusion coating process, heat treatment to be conducted as needed does not necessarily conform to the above-mentioned conditions. For example, heat treatment may be performed in the atmosphere so long as the heat treatment is performed within such a short period of time as not to raise a problem of oxidation-induced ablation.

The surface layer may be formed by the above-mentioned processes in combination with one another. When the surface of the surface layer is roughened as a result of formation by the above-mentioned processes or employment of a blasting process, the surface of the surface layer may be smoothed by grinding or the like.

In the case where the above-mentioned plating process, thermal spraying process, or CVD process is to be used to form a surface layer on the surface of the composite body, no particular limitation is imposed on the composition of material used to form the surface layer so long as the Cr and Al contents of the formed surface layer fall within the respective ranges mentioned above as analyzed after heat treatment of application of heat at 1,000° C. for five hours in the atmosphere. For example, the material may contain Ni in an amount of 70 mass % and Al in an amount of 30 mass %.

In the case where the vapor diffusion coating process is to be used to form a surface layer in the surface of the composite body, Cr and/or Al vapor is diffused into the surface of the composite body. In this case, by means of the composite body in a processing powder being subjected to heat treatment in, for example, a vacuum or an Ar atmosphere, a surface layer having a predetermined composition can be formed. The processing powder is a mixed powder of a metal powder of an element(s) to be diffused, such as a pure Cr powder, a pure Al powder, or an alloy powder which contains Cr and Al, ammonium chloride for promoting diffusion, $Al_2O_3$ for preventing sintering of the processing powder, etc. The mixing ratio of these ingredient powders, and processing conditions vary depending on the total amount of and the surface concentrations of elements to be diffused into the composite body. For example, in the case of diffusion of Al, the mixed powder can be of $Al:NH_4Cl:Al_2O_3=20:2:78$, and the processing conditions are as follows: application of heat at 800° C. to 1,000° C. for about 10 minutes to 10 hours in a nonoxidizing atmosphere, such as Ar or a vacuum. This processing can diffuse Al in the surface of the composite body, thereby forming the surface layer.

By this procedure, the center electrode 2 is formed such that the composite body has a surface layer formed in its surface. After the obtained center electrode 2 is subjected to heat treatment of application of heat at 1,000° C. for five hours in the atmosphere, measurement of hardness and composition by the above-mentioned methods reveals that the outer layer 8 of the center electrode 2 has the high-hardness region having a predetermined hardness and thickness and the element supply region having a predetermined composition and thickness.

The ground electrode 6 can be manufactured from a publicly known material by a method similar to the above-mentioned method for manufacturing the center electrode 2. In the case where the ground electrode 6 does not have an internal core formed from a material having high thermal conductivity, a molten alloy having a predetermined composition is prepared; an ingot is prepared from the molten alloy; the ingot is subjected to plastic working for assuming a predetermined shape and predetermined dimensions, thereby forming the ground electrode 6.

Next, one end portion of the ground electrode 6 is joined to the end surface of the metallic shell 4 by electric resistance welding or laser welding, the metallic shell 4 being formed into a predetermined shape by plastic working, etc. The insulator 3 is formed by firing ceramic or the like into a predetermined shape; the center electrode 2 is assembled to the insulator 3 by a publicly known method; and the resultant insulator 3 is assembled to the metallic shell 4 having the ground electrode 6 joined thereto. Then, the ground electrode 6 is bent toward the center electrode 2 such that a distal end portion of the ground electrode 6 faces a forward end portion of the center electrode 2, thereby yielding the spark plug 1.

The spark plug 1 according to the present invention is used to provide ignition in an automotive internal combustion engine, such as a gasoline engine. The threaded portion 9 of the spark plug 1 is threadingly engaged with a threaded hole provided in a head (not shown) which partially constitutes combustion chambers of the internal combustion engine, whereby the spark plug 1 is fixed in place. The spark plug 1 according to the present invention can be used with an internal combustion engine of any type. However, since the insulator 3 is restrained from cracking caused by deformation of the center electrode 2 and thick accumulation of oxides in an environment of heating and cooling cycles, the spark plug 1 according to the present invention can be preferably used with an internal combustion engine whose combustion chamber temperature is higher than a conventional one.

The spark plug 1 according to the present invention is not limited to the above-mentioned embodiment, but can be modified in various other forms so long as the purpose of the present invention can be achieved. For example, in the above-mentioned spark plug 1, the forward end surface of the center electrode 2 and the surface of one end of the ground electrode 6 face each other in the direction of the axis O with the spark discharge gap G therebetween. However, in the present invention, the side surface of the center electrode and the distal end surface of the ground electrode may face each other in a radial direction of the center electrode with a spark discharge gap therebetween. In this case, one or more ground electrodes may face the side surface of the center electrode.

Furthermore, the above-mentioned spark plug 1 has the center electrode 2 and the ground electrode 6. In the present invention, a noble metal tip may be provided on either one of or both of a forward end portion of the center electrode 2 and the surface of the ground electrode 6. A noble metal tip provided on the forward end portion of the center electrode 2 and/or the surface of the ground electrode 6 usually has a circular columnar or square columnar shape and appropriate dimensions and is welded to the forward end portion of the center electrode 2 and/or the surface of the ground electrode 6 by an appropriate welding method, such as laser welding or electric resistance welding. In this case, a gap formed between the surfaces of two opposing noble metal tips or a gap formed between the surface of the noble metal tip and the surface of the center electrode 2 or the ground electrode 6 serves as the spark discharge gap. A material used to form the noble metal tip is a noble metal, such as Pt, a Pt alloy, Ir, or an Ir alloy.

EXAMPLES

Insulator Push-Cracking Durability Test

<Preparation of Spark Plug Samples>

By use of an ordinary vacuum melting furnace, an Ni base metal was prepared. The Ni base metal was formed into a round bar by cold working. The round bar was formed into a cup shape, thereby yielding a cup body which would become the outer layer. Cu was formed into a round bar by cold working, thereby yielding a rod body. The rod body was inserted into the cup body. The resultant assembly was subjected to plastic working, such as extrusion, followed by wire drawing for forming a composite body.

Next, a surface layer was formed in the surface of the composite body by a method shown in Table 1, thereby preparing a center electrode. The center electrode was assembled to an insulator of ceramic such that their radial difference was 0.03 mm.

Next, by a publicly known method, a ground electrode was joined to one end surface of a metallic shell. The above-prepared insulator assembly was assembled to the metallic shell having the ground electrode joined thereto. The ground electrode was bent toward the center electrode such that a distal end portion of the ground electrode faced the forward end surface of the center electrode, thereby yielding each of spark plug samples.

The prepared spark plug samples had a thread diameter of M12, a core diameter of 1.4 mm, and a center electrode diameter of 1.9 mm. The center electrode projecting dimension; i.e., the distance between the forward end of the center electrode and the forward end of the insulator, was 4 mm. The forward end of the copper core is located forward of the forward end of the metallic shell.

After the spark plug samples were subjected to heat treatment at 1,000° C. for five hours in the atmosphere, as mentioned above, Vickers hardness was measured at predetermined positions according to JIS Z 2244 under the following conditions: test load 1 N and holding time 10 sec. Also, composition was measured by WDS through utilization of EPMA. There were calculated the thickness of the high-hardness region having a hardness of 190 Hv or higher, the thickness of the ultrahigh-hardness region having a hardness of 230 Hv or higher, and the thickness of the element supply region whose subregion in the vicinity of the surface contained Cr in an amount of 15 mass % to 40 mass % and Al in an amount of 0 mass % to 38 mass %, or Al in an amount of 5 mass % to 38 mass % and Cr in an amount of 0 mass % to 40 mass % and whose deeper subregion contained Cr in an amount of 7 mass % to 40 mass % and Al in an amount of 0 mass % to 38 mass %, or Al in an amount of 3 mass % to 38 mass % and Cr in an amount of 0 mass % to 40 mass %.

<Test Method>

The prepared spark plug samples were subjected, for testing, to 3,000 heating and cooling cycles, each consisting of heating at 900° C. with a burner for three minutes and subsequent cooling for one minute. After this test, the diameter of each of the center electrodes was measured by a micrometer at an axial position which fell within an axial range extending 1 mm to 5 mm rearward along the axial direction from the forward end of the core of the center electrode and at which the center electrode was deformed to the greatest extent as observed within the range. The difference between a diameter before the test and a diameter after the test was calculated, and the obtained difference was taken as the amount of deformation of the center electrode. Also, each of the insulators was visually examined for a black contact mark on the wall of the axial bore caused by contact of the center electrode and was also examined for cracking. The results of the examinations were evaluated on the following criteria. Tables 1 and 2 show the results of evaluation.

FF: Cracking of the insulator is observed.

BB: The deformation of the center electrode is 0.025 mm or more, and a contact mark is observed on the insulator.

AA: The deformation of the center electrode is 0.025 mm or more, and no contact mark is observed on the insulator.

$AA^{+}$: The deformation of the center electrode is 0.02 mm to less than 0.025 mm.

$AA^{++}$: The deformation of the center electrode is 0.015 mm to less than 0.02 mm.

$AA^{+++}$: The deformation of the center electrode is less than 0.015 mm.

(Oxidation Resistance Test)<

Preparation of Center Electrode Samples>

Ni was formed into a coreless rod body having a diameter of 1.9 mm by cold working. A surface layer was formed in the surface of the rod body by a method shown in Table 1, thereby preparing a center electrode sample.

<Test Method>

The prepared center electrode samples were subjected, for testing, to 15,000 heating and cooling cycles, each consisting of application of heat at 1,000° C. for two minutes and subsequent cooling for one minute. After this test, the diameter of each of the center electrode samples was measured by a micrometer. The difference between a diameter before the test and a diameter after the test was calculated, and the obtained difference was taken as the amount of reduction of the center electrode sample. The amounts of reduction were evaluated on the following criteria. Tables 1 and 2 show the results of evaluation.

FF: The amount of reduction is 0.1 mm or more.

BB: The amount of reduction is 0.05 mm to less than 0.1 mm.

AA: The amount of reduction is less than 0.05 mm.

TABLE 1

| | | Element supply region | | High-hardness region | | | Evaluation | |
|---|---|---|---|---|---|---|---|---|
| No. | Sample | Composition in the vicinity of surface (*1) (mass %) | Thickness of element supply region (μm) | Thickness of high-hardness region (μm) | Thickness of ultrahigh-hardness region (μm) | Method of forming element supply region | Insulator push-cracking | Oxidation resistance |
| 1 | Comp. Ex. | (No coating) | 20 | 0 | 0 | (No coating) | FF | FF |
| 2 | Comp. Ex. | Ni—14Cr | 120 | 0 | 0 | APS | FF | FF |
| 3 | Comp. Ex. | Ni—15Cr | 40 | 0 | 0 | Vapor | FF | FF |
| 4 | Comp. Ex. | | 50 | 0 | 0 | diffusion | FF | BB |
| 5 | Comp. Ex. | | 100 | 0 | 0 | | FF | AA |
| 6 | Comp. Ex. | | 220 | 0 | 0 | | FF | AA |
| 7 | Comp. Ex. | Ni—14Cr—5Mo | 70 | 30 | 0 | HVOF | FF | FF |
| 8 | Comp. Ex. | | 140 | 100 | 0 | | FF | FF |

TABLE 1-continued

| No. | Sample | Element supply region: Composition in the vicinity of surface (*1) (mass %) | Element supply region: Thickness of element supply region (μm) | High-hardness region: Thickness of high-hardness region (μm) | High-hardness region: Thickness of ultrahigh-hardness region (μm) | High-hardness region: Method of forming element supply region | Evaluation: Insulator push-cracking | Evaluation: Oxidation resistance |
|---|---|---|---|---|---|---|---|---|
| 9 | Comp. Ex. | Ni—14Cr—3Al | 90 | 30 | 0 | LPPS | FF | FF |
| 10 | Comp. Ex. | | 140 | 80 | 0 | | FF | FF |
| 11 | Comp. Ex. | Ni—4Al | 120 | 0 | 0 | APS | FF | FF |
| 12 | Comp. Ex. | Ni—5Al | 40 | 0 | 0 | HVOF | FF | FF |
| 13 | Comp. Ex. | | 70 | 0 | 0 | | FF | BB |
| 14 | Comp. Ex. | | 100 | 0 | 0 | | FF | AA |
| 15 | Comp. Ex. | Ni—15Cr—3Ti | 50 | 20 | 0 | LPPS | FF | FF |
| 16 | Example | | 60 | 30 | 0 | | BB | BB |
| 17 | Example | | 100 | 70 | 0 | | AA | AA |
| 18 | Example | | 110 | 80 | 0 | | $AA^{+}$ | AA |
| 19 | Example | | 180 | 150 | 0 | | $AA^{+}$ | AA |
| 20 | Example | | 220 | 200 | 0 | | $AA^{+}$ | AA |
| 21 | Comp. Ex. | Ni—40Cr—2Ti | 40 | 20 | 0 | HVOF | FF | FF |
| 22 | Example | | 50 | 30 | 0 | | BB | BB |
| 23 | Example | | 90 | 80 | 0 | | AA | BB |
| 24 | Example | | 100 | 90 | 0 | | $AA^{+}$ | AA |
| 25 | Comp. Ex. | Ir—22Cr—14Fe—1.5Si—3Al—0.1Y | 50 | 20 | 0 | HVOF | FF | BB |
| 26 | Example | | 60 | 30 | 0 | | BB | BB |
| 27 | Example | | 110 | 80 | 0 | | $AA^{+}$ | AA |
| 28 | Example | | 220 | 190 | 0 | | $AA^{+}$ | AA |
| 29 | Comp. Ex. | Ni—15Cr—5Al | 40 | 20 | 0 | Vapor diffusion | FF | FF |
| 30 | Example | | 50 | 30 | 0 | | BB | BB |
| 31 | Example | | 80 | 60 | 30 | | AA | BB |
| 32 | Example | | 100 | 70 | 40 | | $AA^{+}$ | AA |
| 33 | Example | | 110 | 80 | 50 | | $AA^{++}$ | AA |
| 34 | Example | | 150 | 130 | 80 | | $AA^{+++}$ | AA |
| 35 | Example | | 220 | 200 | 160 | | $AA^{+++}$ | AA |

(*1) For example, Ni—14Cr means that the Cr content is 14 mass %, and the balance is Ni.

TABLE 2

| No. | Sample | Element supply region: Composition in the vicinity of surface (*1) (mass %) | Element supply region: Thickness of element supply region (μm) | High-hardness region: Thickness of high-hardness region (μm) | High-hardness region: Thickness of ultrahigh-hardness region (μm) | High-hardness region: Method of forming element supply region | Evaluation: Insulator push-cracking | Evaluation: Oxidation resistance |
|---|---|---|---|---|---|---|---|---|
| 36 | Comp. Ex. | Ni—8Al | 40 | 20 | 0 | HVOP | FF | FF |
| 37 | Example | | 50 | 30 | 20 | | BB | BB |
| 38 | Example | | 60 | 40 | 30 | | AA | BB |
| 39 | Example | | 90 | 80 | 60 | | $AA^{+}$ | BB |
| 40 | Example | | 100 | 90 | 70 | | $AA^{++}$ | AA |
| 41 | Example | | 140 | 120 | 80 | | $AA^{+++}$ | AA |
| 42 | Example | | 220 | 200 | 180 | | $AA^{+++}$ | AA |
| 43 | Comp. Ex. | Ni—12Al | 50 | 20 | 0 | LPPS | FF | BB |
| 44 | Example | | 60 | 30 | 0 | | BB | BB |
| 45 | Example | | 100 | 80 | 0 | | $AA^{+}$ | AA |
| 46 | Comp. Ex. | Ni—12Al—2Cr | 40 | 20 | 0 | LPPS | FF | FF |
| 47 | Example | | 50 | 30 | 0 | | BB | BB |
| 48 | Example | | 90 | 80 | 0 | | AA | BB |
| 49 | Example | | 110 | 90 | 0 | | $AA^{+}$ | AA |
| 50 | Example | | 210 | 190 | 0 | | $AA^{+}$ | AA |
| 51 | Comp. Ex. | Ni—20Co—18Cr—12Al—0.5Y | 40 | 20 | 0 | HVOF | FF | FF |
| 52 | Example | | 50 | 30 | 20 | | BB | BB |
| 53 | Example | | 60 | 40 | 30 | | AA | BB |
| 54 | Example | | 100 | 90 | 80 | | $AA^{+++}$ | AA |
| 55 | Example | | 210 | 190 | 180 | | $AA^{+++}$ | AA |
| 59 | Comp. Ex. | Ni—30Al | 40 | 30 | 20 | APS | FF | FF |
| 56 | Example | | 50 | 40 | 30 | | AA | BB |
| 57 | Example | | 90 | 80 | 80 | | $AA^{++}$ | BB |
| 58 | Example | | 100 | 90 | 90 | | $AA^{+++}$ | AA |

TABLE 2-continued

| No. | Sample | Element supply region: Composition in the vicinity of surface (*1) (mass %) | Element supply region: Thickness of element supply region (μm) | High-hardness region: Thickness of high-hardness region (μm) | High-hardness region: Thickness of ultrahigh-hardness region (μm) | Method of forming element supply region | Evaluation: Insulator push-cracking | Evaluation: Oxidation resistance |
|---|---|---|---|---|---|---|---|---|
| 59 | Comp. Ex. | Ni—38Al | 40 | 30 | 30 | Vapor diffusion | FF | FF |
| 60 | Example | | 50 | 40 | 40 | | AA | BB |
| 61 | Example | | 90 | 80 | 80 | | AA++ | BB |

(*1) For example, Ni—14Cr means that the Cr content is 14 mass %, and the balance is Ni.

(Verification Test of Influence of Base Metal Composition)<Preparation of Spark Plug Samples>

Spark plug samples were prepared in a manner similar to that for preparing spark plug samples for the insulator push-cracking durability test except that the Ni base metal composition or the core composition was varied.

<Test Method>

The prepared spark plug samples were subjected to heating and cooling cycles until the insulators cracked, each cycle consisting of heating at 900° C. with a burner for three minutes and subsequent cooling for one minute. The number of cycles until the insulator cracked was counted. Tables 3 and 4 show the test results.

(Verification Test of Influence of Radial Difference)

<Preparation of Spark Plug Samples>

Spark plug samples were prepared in a manner similar to that for preparing spark plug samples for the insulator push-cracking durability test except that the radial difference was varied by varying the inside diameters of axial bores of the insulators.

<Test Method>

The prepared spark plug samples were subjected, for testing, to 3,000 heating and cooling cycles, each consisting of heating at 900° C. with a burner for three minutes and subsequent cooling for one minute. After this test, the center electrode projecting dimension was measured. The difference

TABLE 3

| No. | | Composition in the vicinity of surface (mass %) | Composition of base metal (mass %): Ni | Fe | Cr | Al | Si | Ti | Mn | Y | Hf | Evaluation Push-cracking durability |
|---|---|---|---|---|---|---|---|---|---|---|---|---|
| 26 | Example | Ir—22Cr—14Fe—1.5Si—3Al—0.1Y | 100.0 | | | | | | | | | 3750 |
| 61 | Example | | 99.0 | | 1.0 | | | | | | | 3500 |
| 62 | Example | | 94.9 | | 1.0 | 1.0 | 1.0 | 1.0 | 1.0 | 0.1 | | 3500 |
| 63 | Example | | 90.0 | | 2.5 | 2.0 | 2.0 | 2.0 | 1.5 | | | 3500 |
| 64 | Example | | 90.0 | | 2.0 | 2.5 | 2.0 | 2.0 | 1.5 | | | 3500 |
| 65 | Example | | 90.0 | | 2.0 | 2.0 | 2.0 | 2.0 | 1.5 | | 0.5 | 3500 |
| 66 | Example | | 76.3 | 8.0 | 15.0 | 0.2 | 0.2 | 0.3 | | | | 3000 |
| 67 | Example | | 61.2 | 14.0 | 23.0 | 1.4 | 0.4 | | | | | 3000 |
| 44 | Example | Ni—12Al | 100.0 | | | | | | | | | 3750 |
| 68 | Example | | 99.0 | | 1.0 | | | | | | | 3500 |
| 69 | Example | | 94.9 | | 1.0 | 1.0 | 1.0 | 1.0 | 1.0 | 0.1 | | 3500 |
| 70 | Example | | 90.0 | | 2.5 | 2.0 | 2.0 | 2.0 | 1.5 | | | 3500 |
| 71 | Example | | 90.0 | | 2.0 | 2.5 | 2.0 | 2.0 | 1.5 | | | 3500 |
| 72 | Example | | 90.0 | | 2.0 | 2.0 | 2.0 | 2.0 | 1.5 | | 0.5 | 3500 |
| 73 | Example | | 76.3 | 8.0 | 15.0 | 0.2 | 0.2 | 0.3 | | | | 3000 |
| 74 | Example | | 61.2 | 14.0 | 23.0 | 1.4 | 0.4 | | | | | 3000 |

TABLE 4

| No. | Composition in the vicinity of surface (mass %) | Composition of base metal (mass %): Ni | Composition of core (mass %): Cu | Cr | Zr | Si | Evaluation Push-cracking durability |
|---|---|---|---|---|---|---|---|
| 26 | Ir—22Cr—14Fe—1.5Si—3Al—0.1Y | 100.0 | 100.0 | | | | 3750 |
| 75 | | | 99.2 | 0.8 | | | 3750 |
| 76 | | | 99.1 | 0.8 | 0.13 | | 3750 |
| 77 | | | 95.0 | 3.0 | 2.0 | | 3750 |
| 78 | | | 99.0 | 0.8 | 0.13 | 0.03 | 3750 |
| 79 | | | 95.0 | 2.0 | 2.5 | 0.5 | 3750 |

between a center electrode projecting dimension before the test and a center electrode projecting dimension after the test was calculated, and the obtained difference was taken as the amount of retraction of the center electrode. The amounts of retraction were evaluated on the following criteria. Table 5 shows the results of evaluation.

FF: The amount of retraction is 0.04 mm or more.

CC: The amount of retraction is 0.03 mm to less than 0.04 mm.

BB: The amount of retraction is 0.025 mm to less than 0.03 mm.

AA: The amount of retraction is less than 0.025 mm.

TABLE 5

| Element supply region | Thickness of element supply region (μm) | Composition in the vicinity of surface (mass %) Ni—15Cr—5Al—0.1Si 40 | 50 | 80 | Ni—12Al 50 | 60 | 100 |
|---|---|---|---|---|---|---|---|
| Thickness of high-hardness region (μm) | | 20 | 30 | 60 | 20 | 30 | 80 |
| Thickness of ultrahigh-hardness region (μm) | | 0 | 0 | 30 | 0 | 0 | 0 |
| Radial difference (mm) | 0.12 | FF | CC | CC | FF | CC | CC |
| | 0.1 | CC | BB | BB | CC | BB | BB |
| | 0.09 | CC | BB | BB | CC | BB | BB |
| | 0.08 | CC | BB | BB | CC | BB | BB |
| | 0.07 | CC | AA | AA | CC | AA | AA |
| | 0.05 | CC | AA | AA | CC | AA | AA |
| | 0.04 | CC | AA | AA | CC | AA | AA |
| | 0.03 | CC | AA | AA | CC | AA | AA |

As shown in Tables 1 and 2, the spark plugs whose center electrodes satisfied the specified ranges of the present invention exhibited restraint of cracking of insulators.

As shown in Tables 1 and 2, the spark plugs whose center electrodes failed to satisfy the specified ranges of the present invention involved cracking of insulators.

As shown in Table 3, regardless of the composition of the base metal used to form the outer layer, the spark plugs whose center electrodes satisfied the specified ranges of the present invention exhibited restraint of cracking of insulators.

As shown in Table 4, not only in the case where the core contained Cu in an amount of 100 mass %, but also in the case where the core was formed from a copper alloy, the spark plugs whose center electrodes satisfied the specified ranges of the present invention exhibited restraint of cracking of insulators.

As shown in Table 5, employment of a radial difference which fell within a particular range restrained the center electrode from being retracted toward the interior of the insulator.

DESCRIPTION OF REFERENCE NUMERALS

1: spark plug
2: center electrode
3: insulator
4: metallic shell
5: axial bore
6: ground electrode
7: core
8: outer layer
9: threaded portion
10: talc
11: packing
G: spark discharge gap
d: radial difference
T: forward end of core Having described the invention, the following is claimed:

1. A spark plug comprising:

an insulator having an axial bore extending in a direction of an axis, and a center electrode held in one end portion of the axial bore, the center electrode including a core and an outer layer covering the core, the core being formed from a material higher in thermal conductivity than the outer layer, wherein after heat treatment of application of heat at 1,000° C. for five hours in the atmosphere, the outer layer has:

a high-hardness region having a hardness of 190 Hv or higher and a thickness of 30 μm to 200 μm and an element supply region whose subregion in the vicinity of a surface of the outer layer contains Cr in an amount of 15 mass % to 40 mass % and Al in an amount of 0 mass % to 38 mass %, or Al in an amount of 5 mass % to 38 mass % and Cr in an amount of 0 mass % to 40 mass % and whose deeper subregion contains Cr in an amount of 7 mass % to 40 mass % and Al in an amount of 0 mass % to 38 mass %, or Al in an amount of 3 mass % to 38 mass % and Cr in an amount of 0 mass % to 40 mass %, and the element supply region has a thickness of 50 μm or more.

2. A spark plug according to claim 1, wherein the high-hardness region has an ultrahigh-hardness region having a hardness of 230 Hv or higher, and the ultrahigh-hardness region has a thickness of 30 μm to 200 μm.

3. A spark plug according to claim 1, wherein the high-hardness region has a thickness of 80 μm to 200 μm.

4. A spark plug according to claim 1, wherein the high-hardness region has a thickness of 80 μm to 200 μm, and the ultrahigh-hardness region has a thickness of 30 μm to 80 μm.

5. A spark plug according to claim 1, wherein the ultrahigh-hardness region has a thickness of 80 μm to 200 μm.

6. A spark plug according to claim 1, wherein the element supply region has a thickness of 100 μm or more.

7. A spark plug according to claim 1, wherein, with a side of the axial bore toward the center electrode being referred to as a forward side with respect to the direction of the axis, a radial difference between an outer circumferential surface of the center electrode and an inner circumferential surface of the axial bore is 0.03 mm to 0.1 mm as measured within a range extending along the direction of the axis from a forward end of the core to an axial position located 4 mm rearward of the forward end.

8. A spark plug according to claim 7, wherein the radial difference is 0.03 mm to 0.07 mm.

9. A spark plug comprising:

an insulator having an axial bore extending in a direction of an axis, and a center electrode held in one end portion of the axial bore, the center electrode including a core and an outer layer covering the core, the core being formed from a material higher in thermal conductivity than the outer layer, wherein, through heat treatment of application of heat at 1,000° C. for five hours in the atmosphere, the outer layer has:

a high-hardness region having a hardness of 190 Hv or higher and a thickness of 30 μm to 200 μm and an element supply region whose subregion in the vicinity of a surface of the outer layer contains Cr in an amount of 15 mass % to 40 mass % and Al in an amount of 0 mass % to 38 mass %, or Al in an amount of 5 mass % to 38 mass % and Cr in an amount of 0 mass % to 40 mass %, whose deeper subregion contains Cr in an amount of 7 mass % to 40 mass % and Al in an amount of 0 mass % to 38 mass %, or Al in an amount of 3 mass % to 38 mass % and Cr in an amount of 0 mass % to 40 mass %, and which has a thickness of 50 μm or more.

* * * * *